United States Patent [19]

Fessel et al.

[11] Patent Number: 4,919,188

[45] Date of Patent: Apr. 24, 1990

[54] MOULD AND PROCESS FOR THE PRODUCTION OF NODULAR OR COMPACTED GRAPHITE IRON CASTINGS

[75] Inventors: Manfred Fessel, Rhede; Gerd Trinkl, Borken, both of Fed. Rep. of Germany

[73] Assignee: Foseco International Limited, Birmingham, United Kingdom

[21] Appl. No.: 353,475

[22] Filed: May 17, 1989

[51] Int. Cl.[5] ..... B22C 9/00

[52] U.S. Cl. ..... 164/58.1; 164/349; 164/358

[58] Field of Search ..... 164/55.1, 56.1, 57.1, 164/58.1, 59.1, 349, 358, 364

[56] References Cited

U.S. PATENT DOCUMENTS

| | | | |
|---|---|---|---|
| 4,412,578 | 11/1983 | Doliwa et al. | 164/349 |
| 4,690,196 | 9/1987 | Vernay | 164/349 |

FOREIGN PATENT DOCUMENTS

| | | | |
|---|---|---|---|
| 0067500 | 12/1982 | European Pat. Off. . | |
| 2608282 | 9/1977 | Fed. Rep. of Germany . | |
| 1316744 | 6/1987 | U.S.S.R. | 164/358 |
| 1435373 | 11/1988 | U.S.S.R. | 164/58.1 |
| 1278265 | 6/1972 | United Kingdom . | |
| 1433926 | 4/1976 | United Kingdom . | |
| 1472321 | 5/1977 | United Kingdom . | |
| 1511246 | 5/1978 | United Kingdom . | |
| 1527054 | 10/1978 | United Kingdom . | |
| 2024029A | 1/1980 | United Kingdom . | |

*Primary Examiner*—Richard K. Seidel

*Attorney, Agent, or Firm*—Nixon & Vanderhye

[57] ABSTRACT

A mould for the production of a nodular or compacted graphite iron casting has parts comprising a treatment sprue, a runner, a slag trap, a filter chamber having an ingate and an outlet and having located therein a ceramic filter having an inlet and outlet, a casting cavity ingate, and a casting cavity, and the parts of the mould have a relationship one with another such that F2=0.8 F1 to 1.2 F1, F3=30% F4 - 100% F4, F4≧4.5 F1, F5≧1.3 F1, F6=2 F5 to 4 F5, F7≧F5 and ≦F6, F8≧F5 and ≦F6, F9=1.2 F1 to 3 F1, F10≧F2, L2:L1=3:1 to 8:1 and L1:L3=1:1 to 3:1 where F1 is the cross-sectional area of the filter chamber ingate, F2 is the cross-sectional area of the casting ingate, F3 is the area of the filter outlet, F4 is the area of the filter inlet, F5 is the vertical cross-sectional area of the runner, F6 is the vertical cross-sectional area of the slag trap, F7 is the area of the interface of the reaction sprue and the runner, F8 is the area of the interface of the runner and the slag trap, F9 is the area of the interface of the slag trap and the filter ingate, F10 is the area of the interface of the filter chamber outlet and the casting ingate, L1 is the height of the slag trap, L2 is the length of the slag trap and L3 is the width of the slag trap.

20 Claims, 2 Drawing Sheets

Figure 1:
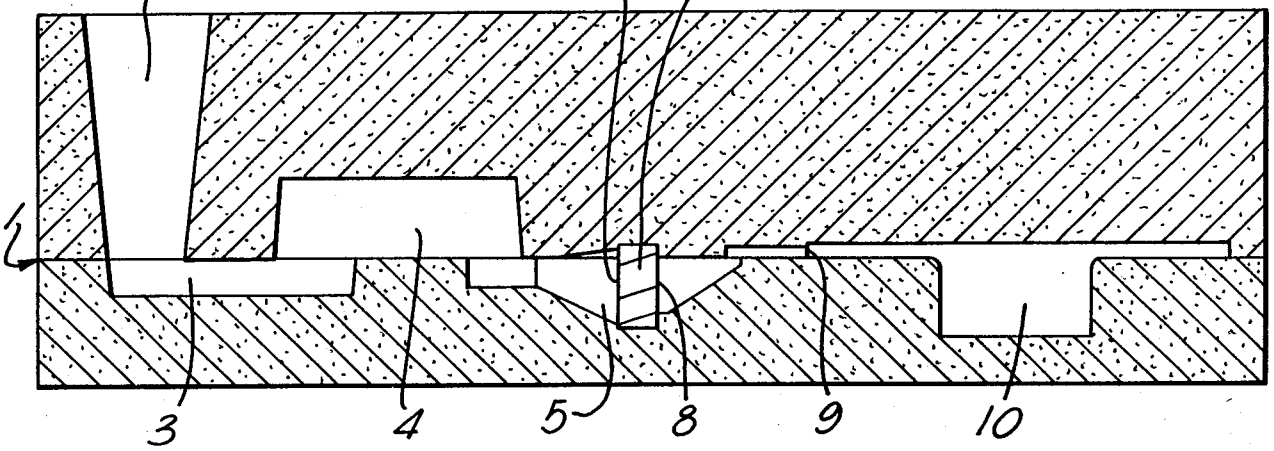

MOULD AND PROCESS FOR THE PRODUCTION OF NODULAR OR COMPACTED GRAPHITE IRON CASTINGS

This invention relates to a mould and a process for the production of nodular or compacted graphite iron castings and it will be described with particular reference to the casting of nodular graphite iron.

Nodular graphite iron (also known as ductile iron or spheroidal graphite iron), is iron in which the graphite is present as nodules or spheroids. In compacted graphite iron (also known as vermicular graphite iron or quasi-flake graphite iron) the form of the graphite is intermediate between the flake graphite form of grey cast iron and the nodular form of nodular iron.

Nodular iron is commonly produced by treating molten iron with magnesium. Small amounts of rare earths are often added in combination with magnesium. Rare earths and elements such as calcium and yttrium which are capable of producing nodular graphite are seldom used on their own.

All the above-mentioned elements are easily oxidised and magnesium is particularly difficult to handle because it boils at a temperature of a little above 1100° C. while the normal casting temperature for molten iron is about 1400° C.

Particular magnesium-containing alloys used for magnesium treatment are for example a 5–10% by weight magnesium-containing ferrosilicon for over-pouring and 20–40% by weight magnesium-containing ferrosilicon for plunging. Coke impregnated with pure magnesium is used for plunging and special treatment vessels and processes are also used for treatment with pure magnesium or with special alloys.

All these methods have in common the fact that the magnesium treatment must be carried out at temperatures which are substantially above the desired casting temperature. Normally the treatment temperature is about 1500° C.

Furthermore, it is common to all these methods, that the magnesium treated iron must be inoculated either in the treatment ladle or directly in the metal stream during the pouring of individual moulds or in the mould in order to form the nuclei in the cast metal which are necessary to avoid the formation of undesirable white iron structures.

During the process of rationalisation and improving the working environment within foundries over the course of the last ten years, many mechanised or automatic pouring units have been brought into use. Holding magnesium treated iron in such heated or unheated pouring units has resulted in particular problems namely:

(a) an excessive loss of magnesium from the molten iron (b) build-up of magnesium reaction products in the pouring unit. For this reason cleaning and/or renewal of the refractory lining is necessary at frequent intervals (c) the regulation of a consistent level of inoculation is difficult and it is only possible to inoculate accurately in the pouring stream whilst pouring individual moulds.

In British Patents Nos. 1 278 265 and 1 511 46 a method is described for the treatment of iron in the mould with magnesium. In this method of nodularising agent is introduced into the mould in one or more intermediate chambers. This method only provides a solution to the problems listed under (a) and (b) above.

The major disadvantages of this method are the poor utilisation of the available mould area leading to a poor yield of casting from a given mould and the poor adaptability of the method to variable process conditions such as temperature and sulphur content. The poor utilisation of the mould area is due to the need for additional reaction chambers; an adjustment is only possible by changing the running system.

British patent specification No. 1 527 054 describes a process for injecting powdered or granular ferro-silicon-magnesium alloys into the pouring stream. It has been shown that the process which has been described is not industrially applicable and yields, even under experimental conditions, only by chance sufficient residual magnesium and therefore spheroidal graphite. Furthermore, a number of factors such as the chemical composition of the alloy, the dependence of the magnesium recovery on the alloy grading and the type and dimensions of the running system need to be considered.

It has now been found that nodular graphite or compacted graphite iron castings can be produced efficiently and consistently using a process in which a magnesium-containing and silicon-containing treatment agent is added to a stream of molten iron in the sprue of a mould if the mould contains a ceramic filter and the parts of the mould have a defined relationship one with another and if the particle size of the treatment agent is controlled.

According to the invention there is provided a mould for the production of a nodular or compacted graphite iron casting the mould having parts comprising a treatment sprue, a runner, a slag trap, a filter chamber having an ingate and an outlet and having located therein a ceramic filter having an inlet and outlet, a casting cavity ingate and a casting cavity, the parts of the mould having a relationship one with another such that $F2 = 0.8\ F1$ to $1.2\ F1$
$F3 = 30\%\ F4$ to $100\%\ F4$
$F4 \geqq 4.5\ F1$
$F5 \geqq 1.3\ F1$
$F6 = 2\ F5$ to $4\ F5$
$F7 \geqq F5$ and $\leqq F6$
$F8 \geqq F5$ and $\leqq F6$
$F9 = 1.2\ F1$ to $3\ F1$
$F10 \geqq F2$
$L2:L1 = 3:1$ to $8:1$ and
$L1:L3 = 1:1$ to $3:1$ where F1 is the cross-sectional area of the filter chamber ingate
F2 is the cross-sectional area of the casting ingate
F3 is the area of the filter outlet F4 is the area of the filter inlet
F5 is the vertical cross-sectional area of the runner
F6 is the vertical cross-sectional area of the slag trap
F7 i s the area of the interface of the reaction sprue and the runner
F8 is the area of the interface of the runner and the slag trap
F9 is the area of the interface of the slag trap and the filter ingate
F10 is the area of the interface of the filter chamber outlet and the casting ingate
L1 is the height of the slag trap
L2 is the length of the slag trap and
L3 is the width of the slag trap.

According to a further feature of the invention there is provided a process for the production of a nodular or compacted graphite iron casting using the mould defined above comprising delivering a particulate magnesium-containing and silicon-containing treatment agent having a particle size of from 0.2–4 mm from a dispenser into a stream of molten iron in the treatment sprue of the mould so that the iron is treated with the treatment agent and flows through the other parts of the mould and through the ceramic filter into the casting cavity.

If the relationship between the various parts of the mould is not as defined above it is not possible to treat molten iron in the mould and guarantee that a fully inoculated nodular or compacted graphite iron casting is produced, or the shape and dimensions of some parts of the mould needed to guarantee efficient treatment and casting production becomes impractical.

For example if F5 is less than 1.3 F1 a full casting is not produced and if F6 is less than 2 F5 separation of slag and reaction products from the treatment process in the slag trap is inadequate. If F8 is less than F5 a full casting is not produced and if F8 is greater than F6 the overall length of the slag trap, L2 needs to be increased because its effective length has been reduced. Similarly, if F9 is less than 1.2 F1 a full casting is not produced and if F9 is greater than 3 F1 effective length of the slag trap is again reduced.

In a preferred embodiment of the mould according to the invention

F2=F1

F3=40% F4 to 60% F4

F4=5 F1 to 7 F1 (when the treatment agent to be used contains approximately 4% by weight magnesium) or 7 F1 to 9 F1 (when the treatment agent to be used contains approximately 6% by weight magnesium) and

F9=1.5 F1 to 2.5 F1.

All of the parts of the mould may be produced by moulding sand around patterns of the required shape and dimensions. Alternatively all the parts apart from the casting cavity can be preformed in one or more units of refractory material and connected to the casting cavity formed in a sand mould via the casting cavity ingate, or the treatment sprue can be formed in refractory material and sand can be moulded around the refractory material.

The treatment sprue is preferably funnel-shaped and has taper from top to bottom at an angle of up to 45° with respect to the vertical axis preferably 3°–25° with respect to the vertical axis. The size of the sprue can vary but its height is preferably in the range from 80 mm to 400 mm depending on the size of the casting to be produced in the mould.

The treatment agent which is capable of producing nodular or compacted graphite iron and of inoculating the iron may be a single alloy or a mixture of particles of two or more alloys.

The magnesium content of the treatment agent used will depend on the size of the casting but should normally be not less than about 2.5% by weight and no more than about 8% by weight. Below about 2.5% by weight magnesium the treatment agent is not cost effective and above about 8% by weight magnesium the treatment agent is too violent. For the production of small castings in nodular iron the preferred magnesium content is 3–5% by weight and for the production of relatively large castings in nodular iron a higher magnesium content treatment agent containing 5–8% by weight magnesium may be used.

The silicon content of the treatment agent required to ensure full inoculation of the iron and a grey structure in the cast iron is within the range of about 40% to about 65% by weight. Up to about 55% by weight of silicon can be achieved using a single magnesium-ferrosilicon alloy. For silicon contents in the treatment agent in excess of about 55% a mixture of a magnesium-ferrosilicon and ferro-silicon can be used.

The treatment agent may contain small quantities of other elements commonly present in magnesium-containing alloys used in the production of nodular iron, such as rare earths, calcium or aluminium, or the treatment agent may contain other elements capable of inoculating iron such as zirconium, strontium or barium, apart from silicon.

Usually the treatment agent will contain not more than 1.5% by weight rare earth, less than 1% by weight calcium and aluminium, not more than 2% by weight zirconium or barium and not more than 0.3% by weight strontium.

The particle size of the treatment agent is preferably 0.4 mm to 2 mm.

The quantity of treatment agent used to produce nodular iron castings will usually be in the range from 0.8% by 2.0% of the weight of iron to be treated and will be delivered to the stream of molten iron at a rate of between 5 g and 200 g per second. For a given treatment agent the quantity used for producing compacted graphite iron castings is less than that used for producing nodular iron castings and will usually be in the range from 0.4% to 1.2% of the weight of iron to be treated.

The dispenser which is used to deliver the treatment agent into the stream of molten iron may be for example apparatus of the type described in British Patent application No. 2024029A. That apparatus has a nozzle which is connected to a source of compressed gas, for example air or an inert gas, means for feeding a treatment agent into the flow of gas from the nozzle and a detector which senses the presence and absence of a stream of molten metal lying in the path of the flow of gas and treatment agent. The detector controls the flow of treatment agent in such a manner that when the stream of molten metal is present the flow of the treatment agent is caused to start and when the molten metal stream ceases the flow of treatment agent is automatically stopped. Such apparatus is available commercially under the name MSI System 90 and is currently used for the metal stream inoculation of molten iron.

A preferred type of apparatus also has means for adjusting the rate of pouring of the molten metal stream, and also means for adjusting the rate of flow of the treatment agent so that throughout pouring the required amount of treatment agent is always delivered to the molten metal stream.

Figure 2:
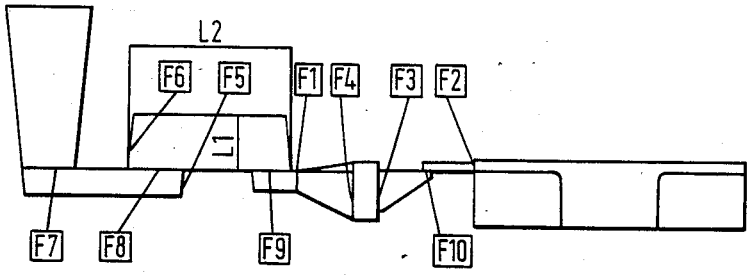
Figure 3:
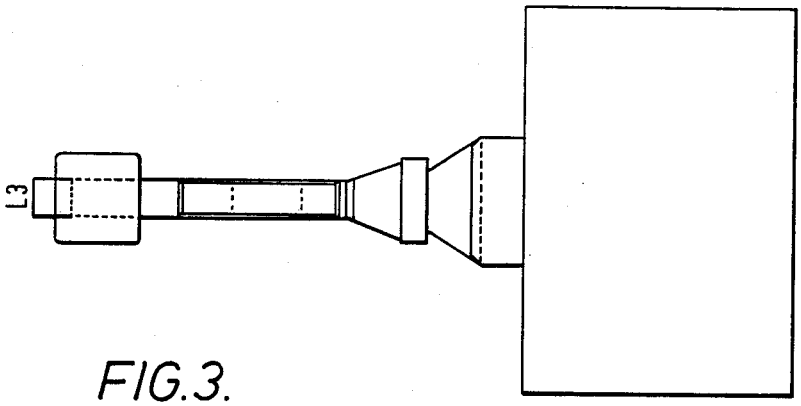

The invention is illustrated with reference to the accompanying drawings in which:

FIG. 1 is a vertical longitudinal section through a mould according to the invention and FIGS. 2 and 3 are a diagrammatic vertical longitudinal section and a diagrammatic top plan view respectively of the mould of FIG. 1 on a reduced scale.

Referring to FIG. 1 a mould 1 for the production of a nodular or compacted graphite iron casting has parts comprising a treatment sprue 2, a runner 3, a slag trap 4, a filter chamber 5 having a ceramic filter 6 (for example a ceramic foam) having an inlet 7 and an outlet 8 located therein, a casting cavity ingate 9 and a casting cavity 10.

Referring to FIGS. 2 and 3 the relationship between the various parts of the mould 1 is such that F2=0.8 F1 to 1.2 F1

F3=30% F4 to 100% F4

F4≧4.5 F1

F5≧1.3 F1

F6=2 F5 to 3 F5

F7≧F5 and ≦F6

F8≧F5 and ≦F6

F9=1.2 F1 to 3 F1

F10≧F2

L2:L1=3:1 to 8:1 and

L1:L3=1:1 to 3:1 where

F1 is the cross-sectional area of the filter chamber ingate

F2 is the cross-sectional area of the casting ingate

F3 is the area of the filter outlet F4 is the area of the filter inlet

F5 is the vertical cross-sectional area of the runner

F6 is the vertical cross-sectional area of the slag trap

F7 is the area of the interface of the reaction sprue and the runner

F8 is the area of the interface of the runner and the slag trap

F9 is the area of the interface of the slag trap and the filter ingate

F10 is the area of the interface of the filter chamber outlet and

L1 is the height of the slag trap

L2 is the length of the slag trap and

L3 is the width of the slag trap.

The mould illustrated in the drawings is designed for the production of castings on an experimental basis. Usually, for the production of castings on a commercial basis, the mould would have in addition to the parts described a feeder, optionally surrounded by a feeder sleeve and located either above or to the side of the casting cavity 10.

In use molten iron is poured from for example a ladle or a launder (not shown) into the treatment sprue 2 and particulate magnesium-containing and silicon-containing treatment agent having a particle size of 0.2–4 mm is delivered from a dispenser (not shown) into the molten iron stream entering the treatment sprue 2. The molten iron is treated by the treatment agent in the treatment sprue 2 and flows through the runner 3, the slag trap 4 and the ceramic filter 6 into the casting cavity 10. Slag or dross and reaction products from the treatment process are removed from the iron as it flows through the mould by the slag trap 4 and the ceramic filter 6.

A series of tests was carried out to determine (1) the influence of magnesium content of the treatment agent on the magnesium recovery (2) the influence of the length of the slag trap on the magnesium recovery (3) The effect of the particle size of the treatment agent on the magnesium recovery and (4) the effect of the size of a ceramic foam filter on the magnesium recovery using a mould as illustrated in the drawings and a dispenser as described in British Patent application No. 2024029A.

In each test molten iron containing 3.6–3.7% carbon, 1.6–1.7% of silicon, 0.3% manganese and 0.015% sulphur was poured into the treatment sprue of the mould at a temperature of 1440° C.

The treatment agent was a magnesium-containing ferrosilicon alloy and the ceramic foam filter had about 4 pores per cm.

Further detailed of the tests and the results obtained are tabulated below.

In the tables:

N indicates fully nodular iron containing less than 5% perlite

N10 indicates a fully nodular iron containing 10% perlite

60/40 indicates an iron containing 60% nodular graphite and 40% compacted graphite and D indicates that the casting contains dross.

TABLE 1

INFLUENCE OF MAGNESIUM CONTENT OF TREATMENT AGENT ON MAGNESIUM RECOVERY

| Example No. | 1 | 2 | 3 |
|---|---|---|---|
| Treatment alloy | | | |
| % Mg | 3.9 | 5.8 | 9.2 |
| Grading (mm) | 0.4–2 | 0.4–2 | 0.4–2 |
| Addition rate (%) | 1.92 | 1.64 | 1.41 |
| Mould details | | | |
| F1 ($mm^2$) | 600 | 600 | 600 |
| F2 ($mm^2$) | 600 | 600 | 600 |
| F3 ($mm^2$) | 2100 | 2100 | 2100 |
| F4 ($mm^2$) | 3930 | 3930 | 3930 |
| F5 ($mm^2$) | 800 | 800 | 800 |
| F6 ($mm^2$) | 1600 | 1600 | 1600 |
| F7 ($mm^2$) | 1200 | 1200 | 1200 |
| F8 ($mm^2$) | 1600 | 1600 | 1600 |
| F9 ($mm^2$) | 1200 | 1200 | 1200 |
| F10 ($mm^2$) | 1000 | 1000 | 1000 |
| L1 (mm) | 50 | 50 | 50 |
| L2 (mm) | 150 | 150 | 150 |
| L3 (mm) | 35 | 35 | 35 |
| Filter dimensions (mm) | 50 × 75 | 50 × 75 | 50 × 75 |
| Results | | | |
| Residual Mg (%) | 0.037 | 0.034 | 0.032 |
| Silicon recovery (%) | 88 | 65 | 54 |
| Mg recovery (%) | 49 | 35 | 25 |
| Structure | N | N | N 10 |
| Full casting | YES | NO | NO |

TABLE 2

INFLUENCE OF SLAG TRAP LENGTH ON MAGNESIUM RECOVERY

| Example No. | 1 | 4 | 5 |
|---|---|---|---|
| Treatment alloy | | | |
| % Mg | 3.9 | 3.9 | 3.9 |
| Grading (mm) | 0.4–2 | 0.4–2 | 0.4–2 |
| Addition rate (%) | 1.92 | 1.77 | 1.82 |
| Mould details | | | |
| F1 ($mm^2$) | 600 | 600 | 600 |
| F2 ($mm^2$) | 600 | 600 | 600 |
| F3 ($mm^2$) | 2100 | 2100 | 2100 |
| F4 ($mm^2$) | 3930 | 3930 | 3930 |
| F5 ($mm^2$) | 800 | 800 | 800 |
| F6 ($mm^2$) | 1600 | 1600 | 1600 |
| F7 ($mm^2$) | 1200 | 1200 | 1200 |
| F8 ($mm^2$) | 1600 | 1600 | 1600 |
| F9 ($mm^2$) | 1200 | 1200 | 1200 |
| F10 ($mm^2$) | 1000 | 1000 | 1000 |
| L1 (mm) | 50 | 50 | 50 |
| L2 (mm) | 150 | 110 | 400 |
| L3 (mm) | 35 | 35 | 35 |
| Filter dimensions (mm) | 50 × 75 | 50 × 75 | 50 × 75 |
| Results | | | |
| Residual Mg (%) | 0.037 | 0.033 | 0.051 |
| Silicon recovery (%) | 88 | 95 | 87 |
| Mg recovery (%) | 49 | 48 | 75 |
| Structure | N | N | N |
| Full casting | YES | NO | YES |

TABLE 3

EFFECT OF TREATMENT AGENT GRADING ON MAGNESIUM RECOVERY

| Example No. | 1 | 6 | 7 | 8 |
|---|---|---|---|---|
| Treatment alloy | | | | |
| % Mg | 3.9 | 3.9 | 3.9 | 3.9 |
| Grading (mm) | 0.4–2 | 0.4–0.8 | 0–2 | 1–2 |
| Addition rate (%) | 1.92 | 2.26 | 2.30 | 1.83 |
| Mould details | | | | |
| F1 ($mm^2$) | 600 | 600 | 600 | 600 |
| F2 ($mm^2$) | 600 | 600 | 600 | 600 |
| F3 ($mm^2$) | 2100 | 2100 | 2100 | 2100 |
| F4 ($mm^2$) | 3930 | 3930 | 3930 | 3930 |
| F5 ($mm^2$) | 800 | 800 | 800 | 800 |
| F6 ($mm^2$) | 1600 | 1600 | 1600 | 1600 |
| F7 ($mm^2$) | 1200 | 1200 | 1200 | 1200 |
| F8 ($mm^2$) | 1600 | 1600 | 1600 | 1600 |
| F9 ($mm^2$) | 1200 | 1200 | 1200 | 1200 |
| F10 ($mm^2$) | 1000 | 1000 | 1000 | 1000 |
| L1 (mm) | 50 | 50 | 50 | 50 |
| L2 (mm) | 150 | 150 | 150 | 150 |
| L3 (mm) | 35 | 35 | 35 | 35 |
| Filter dimensions (mm) | 50 × 75 | 50 × 75 | 50 × 75 | 50 × 75 |
| Results | | | | |
| Residual Mg (%) | 0.037 | 0.026 | 0.029 | 0.040 |
| Silicon-recovery (%) | 88 | 72 | 91 | 92 |
| Mg recovery (%) | 49 | 29 | 37 | 56 |
| Structure | N | 60/40 | N | N |
| Full casting | YES | NO | NO | YES |

TABLE 4

EFFECT OF FILTER SIZE ON MAGNESIUM RECOVERY

| Example No. | 1 | 9 | 10 | 11 | 12 |
|---|---|---|---|---|---|
| Treatment alloy | | | | | |
| % Mg | 3.9 | 3.9 | 3.9 | 5.8 | 9.2 |
| Grading (mm) | 0.4–2 | 0.4–2 | 0.4–2 | 0.4–2 | 0.4–2 |
| Addition rate (%) | 1.92 | 1.95 | 2.06 | 1.88 | 1.64 |
| Mould details | | | | | |
| F1 ($mm^2$) | 600 | 600 | 600 | 600 | 600 |
| F2 ($mm^2$) | 600 | 600 | 600 | 600 | 600 |
| F3 ($mm^2$) | 2100 | 2100 | 2100 | 2100 | 2100 |
| F4 ($mm^2$) | 3930 | 3930 | 3930 | 3930 | 3930 |
| F5 ($mm^2$) | 800 | 800 | 800 | 800 | 800 |
| F6 ($mm^2$) | 1600 | 1600 | 1600 | 1600 | 1600 |
| F7 ($mm^2$) | 1200 | 1200 | 1200 | 1200 | 1200 |
| F8 ($mm^2$) | 1600 | 1600 | 1600 | 1600 | 1600 |
| F9 ($mm^2$) | 1200 | 1200 | 1200 | 1200 | 1200 |
| F10 ($mm^2$) | 1000 | 1000 | 1000 | 1000 | 1000 |
| L1 (mm) | 50 | 50 | 50 | 50 | 50 |
| L2 (mm) | 150 | 150 | 150 | 150 | 150 |
| L3 (mm) | 35 | 35 | 35 | 35 | 35 |
| Filter dimensions (mm) | 50 × 75 | 50 × 50 | 50 × 100 | 50 × 100 | 50 × 100 |
| Results | | | | | |
| Residual Mg (%) | 0.037 | 0.035 | 0.043 | 0.058 | 0.067 |
| Silicon-recovery (%) | 88 | 75 | 97 | 84 | 75 |
| Mg recovery (%) | 49 | 46 | 54 | 54 | 55 |
| Structure | N | — | N | N | N |
| Full casting | YES | NO | YES | YES (D) | YES (D) |

We claim:

1. A mould for the production of a nodular or compacted graphite iron casting the mould having parts comprising a treatment sprue, a runner, a slag trap, a filter chamber having an ingate and an outlet and having located therein a ceramic filter having an inlet and outlet, a casting cavity ingate and a casting cavity, the parts of the mould having a relationship one with another such that

F2=0.8 F1 to 1.2 F1
F3=30% F4 - 100% F4
F4≧4.5 F1
F5≧1.3 F1
F6=2 F5 - 4 F5
F7≧F5 and ≦F6
F8≧F5 and ≦F6
F9=1.2 F1 - 3 F1
F10≧F2
L2:L1=3:1 to 8:1
L1:L3=1:1 to 3:1 where

F1 is the cross-sectional area of the filter chamber ingate
F2 is the cross-sectional area of the casting ingate
F3 is the area of the filter outlet
F4 is the area of the filter inlet
F5 is the vertical cross-sectional area of the runner
F6 is the vertical cross-sectional area of the slag trap
F7 is the area of the interface of the reaction sprue and the runner
F8 is the area of the interface of the runner and the slag trap
F9 is the area of the interface of the slag trap and the filter ingate
F10 is the area of the interface of the filter chamber outlet and the casting ingate
L1 is the height of the slag trap
L2 is the length of the slag trap and
L3 is the width of the slag trap

2. A mould according to claim 1 wherein
F2=F1
F3=40% F4 to 60% F4
F4=5 F1 to 7 F1
F9=1.5 F1 to 2.5 F1.

3. A mould according to claim 1 wherein
F2=F1
F3=40% to 60% F4
F4=7 F1 to 9 F1 and
F9=1.5 F1 to 2.5 F1

4. A mould according to claim 1 wherein all the parts of the mould are produced by moulding sand around patterns of the required shape and dimensions.

5. A mould according to claim 1 wherein all the parts of the mould apart from the casting cavity are preformed in one or more units of refractory material and connected to the casting cavity formed in a sand mould via the casting cavity ingate.

6. A mould according to claim 1 wherein the treatment sprue is formed in refractory material and sand is moulded around the refractory material.

7. A mould according to claim 1 wherein the treatment sprue is funnel-shaped.

8. A mould according to claim 7 wherein the treatment sprue tapers from top to bottom at an angle of up to 45° with respect to the vertical axis.

9. A mould according to claim 8 wherein the treatment sprue tapers from top to bottom at an angle of 3°–25° with respect to the vertical axis.

10. A mould according to claim 1 wherein the height of the treatment sprue is 80 mm to 400 mm.

11. A process for the production of a nodular or compacted graphite iron casting comprising providing a mould having parts comprising a treatment sprue, a runner, a slag trap, a filter chamber having an ingate and an outlet and having located therein a ceramic filter having an inlet and outlet, a casting cavity ingate and a casting cavity, the parts of the mould having a relationship one with another such that $F2=0.8\ F1$ to $1.2\ F1$
$F3=30\%\ F4 - 100\%\ F4$
$F4 \geqq 4.5\ F1$
$F5 \geqq 1.3\ F1$
$F6=2\ F5 - 4\ F5$
$F7 \geqq F5$ and $< F6$
$F8 \geqq F5$ and $< F6$
$F9=1.2\ F1 - 3\ F1$
$F10 \geqq F2$
$L2:L3=3:1$ to $8:1$
$L1:L3=1:1$ to $3:1$ where F1 is the cross-sectional area of the filter chamber ingate
F2 is the cross-sectional area of the casting ingate
F3 is the area of the filter outlet
F4 is the area of the filter inlet
F5 is the vertical cross-sectional area of the runner
F6 is the vertical cross-sectional area of the slag trap
F7 is the area of the interface of the reaction sprue and the runner
F8 is the area of the interface of the runner and the slag trap
F9 is the area of the interface of the slag trap and the filter ingate
F10 is the area of the interface of the filter chamber outlet and the casting ingate
L1 is the height of the slag trap
L2 is the length of the slag trap and
L3 is the width of the slag trap and delivering a particulate magnesium-containing and silicon-containing treatment agent having a particle size of from 0.2 to 4 mm from a dispenser into a stream of molten iron in the treatment sprue of the mould so that the iron is treated with the treatment agent and flows through the other parts of the mould and through the ceramic filter into the casting cavity.

12. A process according to claim 11 wherein the treatment agent is a mixture of two or more alloys.

13. A process according to claim 11 wherein the treatment agent contains 2.5 to 8% by weight magnesium.

14. A process according to claim 11 wherein the treatment agent contains 40 to 65% by weight silicon.

15. A process according to claim 11 wherein the treatment agent contains not more than 1.5% by weight rare earth, less than 1% by weight calcium and aluminium, not more than 2% by weight zirconium or barium and not more than 0.3% strontium.

16. A process for producing a nodular iron casting according to claim 11 wherein the quantity of treatment agent used is from 0.8% to 2.0% of the weight of the iron to be treated.

17. A process for producing a compacted graphite iron casting according to claim 11 wherein the quantity of treatment agent is from 0.4% to 1.2% of the weight of the iron to be treated.

18. A process according to claim 11 wherein the treatment agent is delivered to the stream of molten iron at a rate of between 5 g and 200 g per second.

19. A process according to claim 11 wherein the particle size of the treatment agent is 0.4–2 mm.

20. A process according to claim 11 wherein the treatment is a single alloy.

* * * * *